United States Patent [19]

Humphrey

[11] Patent Number: 4,840,727

[45] Date of Patent: Jun. 20, 1989

[54] DOUBLE BANK GRAIN CLEANER AND ASPIRATOR THEREFOR

[76] Inventor: Cecil T. Humphrey, 3744 Linwood St., Burnaby, Canada

[21] Appl. No.: 451,302

[22] Filed: Dec. 20, 1982

[30] Foreign Application Priority Data

Dec. 30, 1981 [CA] Canada ..... 393429

[51] Int. Cl.[4] ..... B07B 9/02; B07B 7/01

[52] U.S. Cl. ..... 209/32; 209/134; 209/151; 406/86; 406/119; 406/168

[58] Field of Search ..... 209/315, 254, 133–137, 209/149, 151, 146, 147, 153, 154, 31–37, 366.5, 300; 74/61, 87; 406/168, 86, 119, 117, 90

[56] References Cited

U.S. PATENT DOCUMENTS

| | | | |
|---|---|---|---|
| 169,308 | 10/1875 | Sower | 209/153 |
| 517,721 | 4/1894 | Armbruster | 209/315 |
| 522,421 | 7/1894 | Jones | 209/151 |
| 552,769 | 1/1896 | Mober | 209/35 |
| 717,971 | 1/1903 | Colvin | 209/146 |
| 728,473 | 5/1903 | Lane | 209/153 |
| 750,092 | 1/1904 | Cornwall | 209/32 |
| 852,050 | 4/1907 | Barbeau | 209/254 |
| 1,109,299 | 9/1914 | Morse | 209/37 |
| 1,530,277 | 3/1925 | Mettler | 209/137 |
| 1,987,640 | 4/1933 | Rothgarn | 209/136 |
| 2,120,613 | 6/1938 | Johnson | 209/135 |
| 2,130,834 | 9/1938 | Berry | 209/415 |
| 2,147,911 | 2/1939 | Menk | 209/135 |
| 2,683,533 | 7/1954 | Paul . | |
| 2,700,471 | 6/1955 | Harvengt . | |
| 2,908,391 | 10/1959 | Frevert . | |
| 3,180,492 | 4/1965 | Vandenhoeck | 209/154 |
| 3,422,955 | 1/1969 | Mock et al. . | |
| 3,688,902 | 9/1972 | Hubach . | |
| 3,819,050 | 6/1974 | Lower | 209/254 |
| 4,107,035 | 8/1978 | Foresman . | |
| 4,234,416 | 11/1980 | Lower et al. . | |
| 4,258,005 | 3/1981 | Ito | 406/90 |
| 4,279,549 | 7/1981 | Hanrot | 406/90 |
| 4,529,106 | 7/1985 | Broadfoot | 406/119 |
| 4,552,573 | 11/1985 | Weis | 406/168 |
| 4,634,522 | 1/1987 | Edholm | 209/36 |

FOREIGN PATENT DOCUMENTS

| | | | |
|---|---|---|---|
| 650578 | 10/1962 | Canada . | |
| 892393 | 2/1972 | Canada . | |
| 897636 | 4/1972 | Canada . | |
| 1014894 | 8/1977 | Canada . | |
| 1100783 | 5/1981 | Canada . | |
| 1042842 | 11/1982 | Canada . | |
| 328775 | 1/1903 | France | 209/137 |
| 0718183 | 2/1980 | U.S.S.R. | 209/254 |
| 3481 | 10/1875 | United Kingdom | 209/137 |
| 257287 | 2/1927 | United Kingdom | 209/134 |

*Primary Examiner*—Kenneth M. Schor

*Attorney, Agent, or Firm*—Finnegan, Henderson, Farabow, Garrett & Dunner

[57] ABSTRACT

A double bank cleaner for granular material includes two spaced banks of cleaning decks mounted in a frame with a drive motor and rotatable eccentric positioned between the two banks so that the banks of decks can be gyrated in a flat, horizontal plane. An aspirator for the double bank cleaner is also disclosed, and which comprises a plurality of feeders each of which creates a curtain of granular material through which air is passed to remove dust and the like.

3 Claims, 6 Drawing Sheets

DOUBLE BANK GRAIN CLEANER AND ASPIRATOR THEREFOR

FIELD OF THE INVENTION

This invention relates to devices for cleaning granular material and in particular to a double bank cleaner for granular material such as grain and the like.

BACKGROUND OF THE INVENTION

It has been known to arrange granular cleaning devices in a double bank configuration as shown for example in U.S. Pat. No. 4,234,416 of Nov. 18, 1980, Lower et al. In that device, the screening machine is arranged in a multiple deck configuration with the feed material being divided into separate, equal fractions as it falls into parallel vertical channels. Each of these channels is directed to a particular screen deck by way of a chute that diverts the respective feed from the channel onto the screen. However, there are disadvantages in such known devices in that the sets of decks are actually two pairs, discharging the feed material towards the center. The infeed is split to feed both sides of the machine, the length of each cleaning deck being restricted to the distance from the side of the machine to a point adjacent the center as shown for example in FIG. 1 of the Lower patent. It will be seen from that Figure as well as from FIG. 2 of the patent that the feed is directed down the sides of the machine onto the decks which slope toward the center.

Conventional machines have also been supported on the wire ropes and the like, the strands in the rope eventually fraying and being subjected to failure.

SUMMARY OF THE INVENTION

A double bank cleaner according to the present invention overcomes many of the disadvantages of known devices in providing two separated sets of decks which function in a cleaning mode from one side of the machine clear through to the other. The feeding and discharge chutes to the decks can therefore be much simpler and as the decks are of a substantial length a better cleaning function is obtained. Because the two sets of decks in the present invention function from one side of the machine to the other, each side can be running on different materials and each side can be separately fed. In the conventional mechanisms, the infeed is split to feed both sides of the machine with a central takeoff and the granular material cannot be mixed. In addition, the full length decks of the present invention provide a much greater total screening area than conventional devices and with both ends of the decks in the present invention being accessible, the decks can be easily serviced for cleaning and the like.

The double bank cleaner of the present invention also incorporates a balanced drive system allowing speeds of rotation much higher than in conventional cleaners than are driven by eccentrics and linkage. The high speed flat rotary action of the present invention presents a maximum of screen surface to granular material. This flat rotary action is similar to the motion of a hand held sieve, the motion to the decks actually being achieved in a similar way to a hand sieve in that an eccentric weight is rotated to throw the decks into a flat, circular path which is very positive and automatically balanced.

The screening decks are mounted on an inner frame which is suspended from an outer, perimeter frame by four needle-bearing universal hangers which are sealed and require minimum lubrication. Thus, there is less chance of wear and breakage as in wire rope suspended devices.

The cleaner of the present invention may also incorporate an aspirating device which includes a plurality of feeders each of which creates a curtain of granular material through which air is passed to remove dust and the like.

According to one broad aspect, the invention relates to a double bank cleaning device for granular and like material comprising an outer frame and an inner frame with means suspending the inner frame from the outer frame for limited movement therein. Two spaced banks of cleaning decks are mounted in and secured to the inner frame and driving means is mounted on the inner frame centrally of the two spaced banks of cleaning decks, each cleaning deck of each bank operating to carry granular material from one end of the device to the other. The drive means includes a rotatable eccentric weight and a motor for rotating of the weight to impart a flat, rotary motion to the suspended inner frame and the double bank of cleaning decks therein.

According to another aspect, the invention relates to a double bank cleaning device for granular and like materials comprising an outer frame and an inner frame, connecting members suspending the inner frame from the outer frame for a limited rotary movement of the inner frame therein and drive means with a rotatable eccentric weight mounted centrally of the inner frame and connected thereto for imparting rotary movement to the inner frame. Two spaced banks of cleaning decks are mounted to the inner frame, one bank on either side of the drive means and operating to carry granular material from one side of the device to the other. A multi-feed aspirator for feeding granular material into the device consists of a housing mounted on the top of the outer frame and includes a plurality of horizontal disposed feed rolls mounted in the housing, one above and forward of the other with each roll feeding a curtain of granular material by gravity, down through the housing and into the infeed ends of the decks. A plurality of ducts direct air generally horizontally against the curtains of granular material to carry lighter than grain pieces into a dropout section of the housing.

According to a still further aspect, the invention relates to an aspirator for mounting on top of a grain cleaning machine comprising:

a housing having an intake section and an exhaust section, said housing being adapted for connection to fan means for passing air through said housing from the intake to the exhaust section;

said intake section having an inlet in its upper end for receiving granular material therein, and an outlet in its lower end for dropping granular material into cleaning decks of said cleaning machine;

baffle means dividing said intake section between its granular inlet and outlet and extending generally diagonally across said intake section;

means in said baffle for metering granular material therethrough in a plurality of downwardly flowing curtains extending across said intake section; and means for directing the air passing through the housing to impinge upon said downwardly flowing curtains thereby to carry material lighter than said granular material out of said intake section and into said exhaust section.

BRIEF DESCRIPTION OF THE DRAWINGS

The present invention is illustrated by way of example in the accompanying drawings in which.

DESCRIPTION OF THE PREFERRED EMBODIMENT

Figure 2:
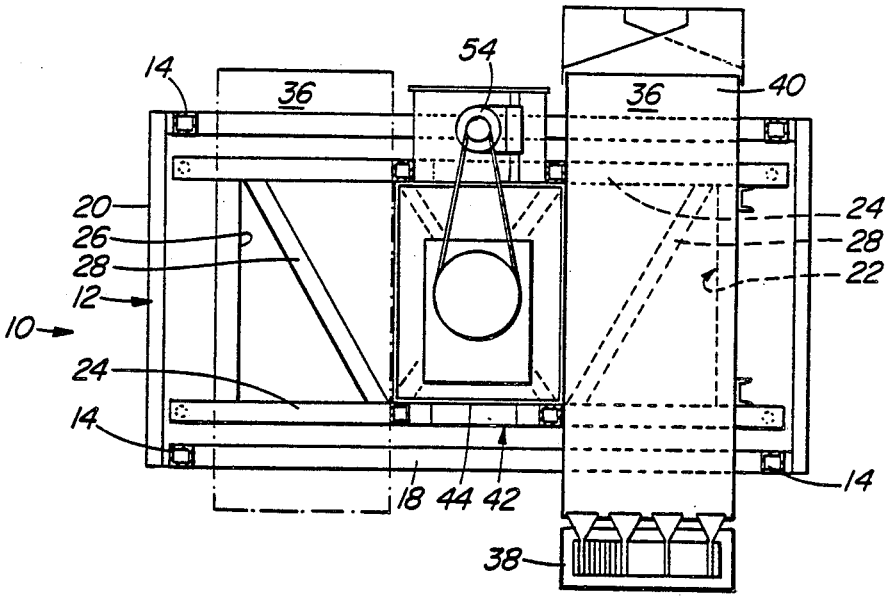
FIG. 2 is a plan view of the cleaner shown in FIG. 1.
Figure 1:
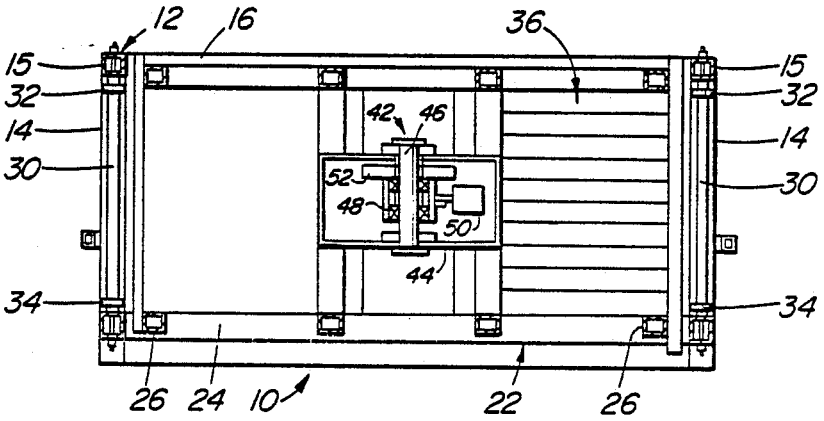
FIG. 1 is a schematic, end elevation of the double bank cleaner according to the present invention.

Referring to FIGS. 1 and 2, a cleaning device according to the invention is illustrated at 10 and includes an outer perimeter frame consisting of upright corner posts 14 interconnected by upper and lower cross beams 16, 18 and end members 20. An inner frame 22 comprises a floor made up of longitudinal beam members 24, cross beams 26 and diagonal bracing members 28. This inner frame is suspended from the outer frame 12 through a plurality of steel hangers 30 connected at their upper ends by automotive type universal joints 32 to the upper end beams 15 of the outer frame and, at their lower ends, the steel members 30 support the inner frame 22 by being connected through further automotive type universal joints 34 to the longitudinal beams 24 of the inner frame. While the drawings illustrate the use of four hangers 30, this number may be increased if necessary to minimize frame deflection.

It will be understood from FIGS. 1 and 2 that each side of the inner frame 22 carries a stack of cleaning decks shown generally at 36 and is illustrated at FIG. 2, the decks extend at least the full width of the apparatus 10, each deck having an infeed end 38 and a discharge end 40. The discharge end illustrated is a two-way discharge but could be three-way or more according to the requirements of the device.

Mounted centrally of the two banks 36 of decks is a drive mechanism 42 comprising a box 44 secured to the inner frame and supporting therein a dead shaft 46 and on which is mounted a large bearing and sleeve 48 supporting an eccentric weight 50, the sleeve and weight being rotated by means of a pulley 52 driven by suitable motor means 54 mounted outside the drive box. Actuation of the weight 50 imparts a flat, rotary movement to the inner frame 22 and the decks 36 mounted therein.

Figure 3:
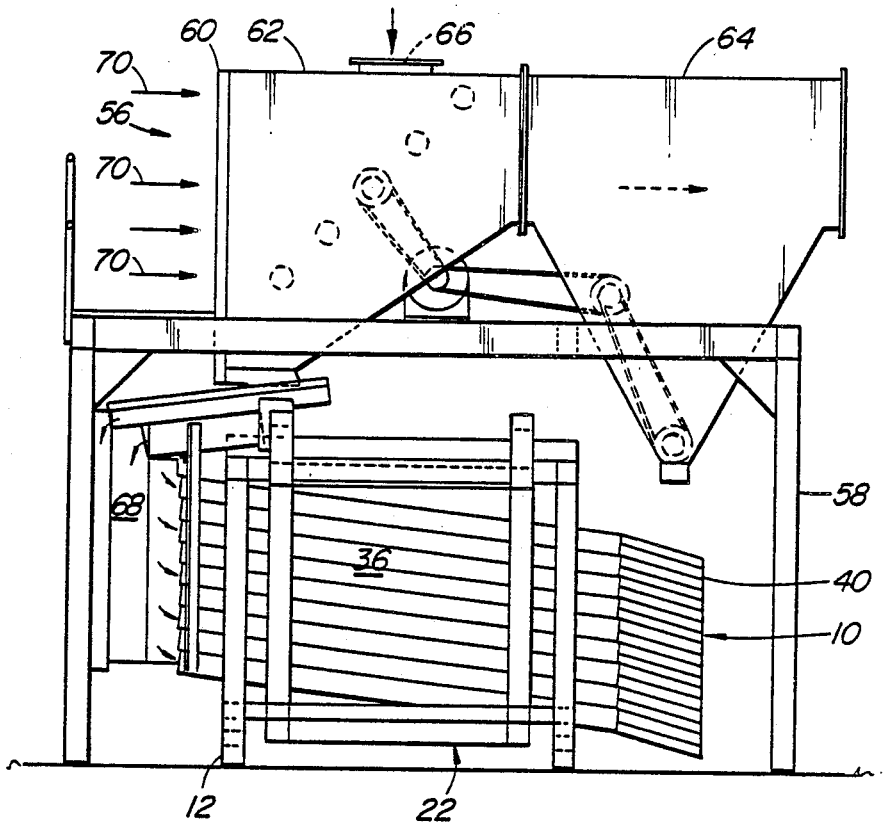
FIG. 3 is a side elevation of the cleaner in FIGS. 1 and 2 showing an aspirator located on the top of the device.
Figure 4:
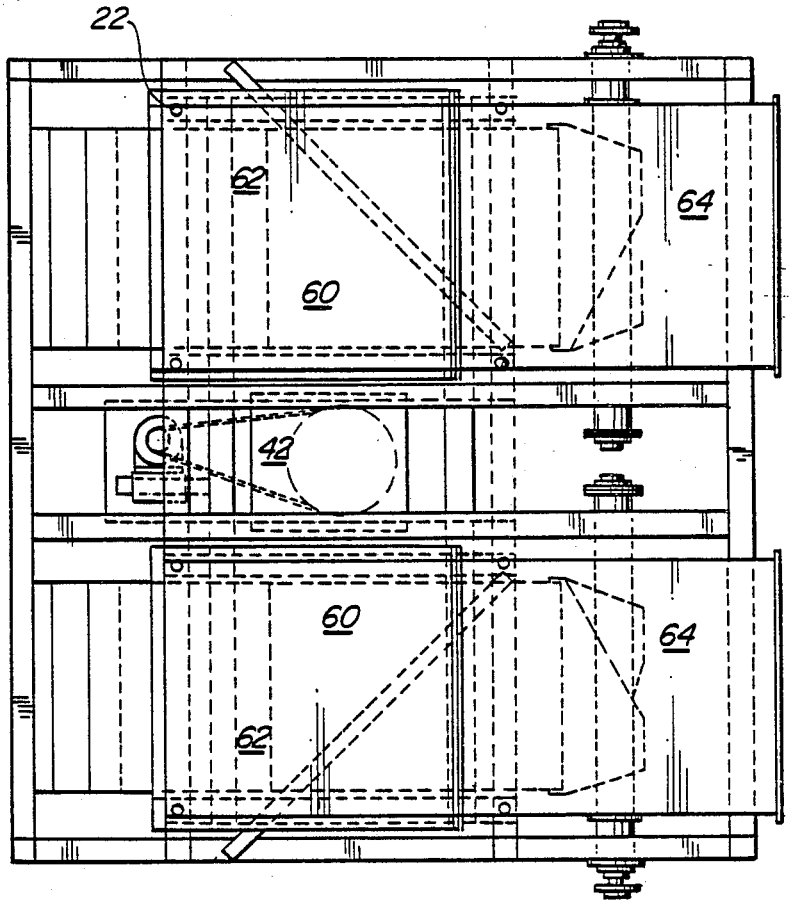
FIG. 4 is a plan view of the apparatus shown in FIG. 3.
Figure 5:
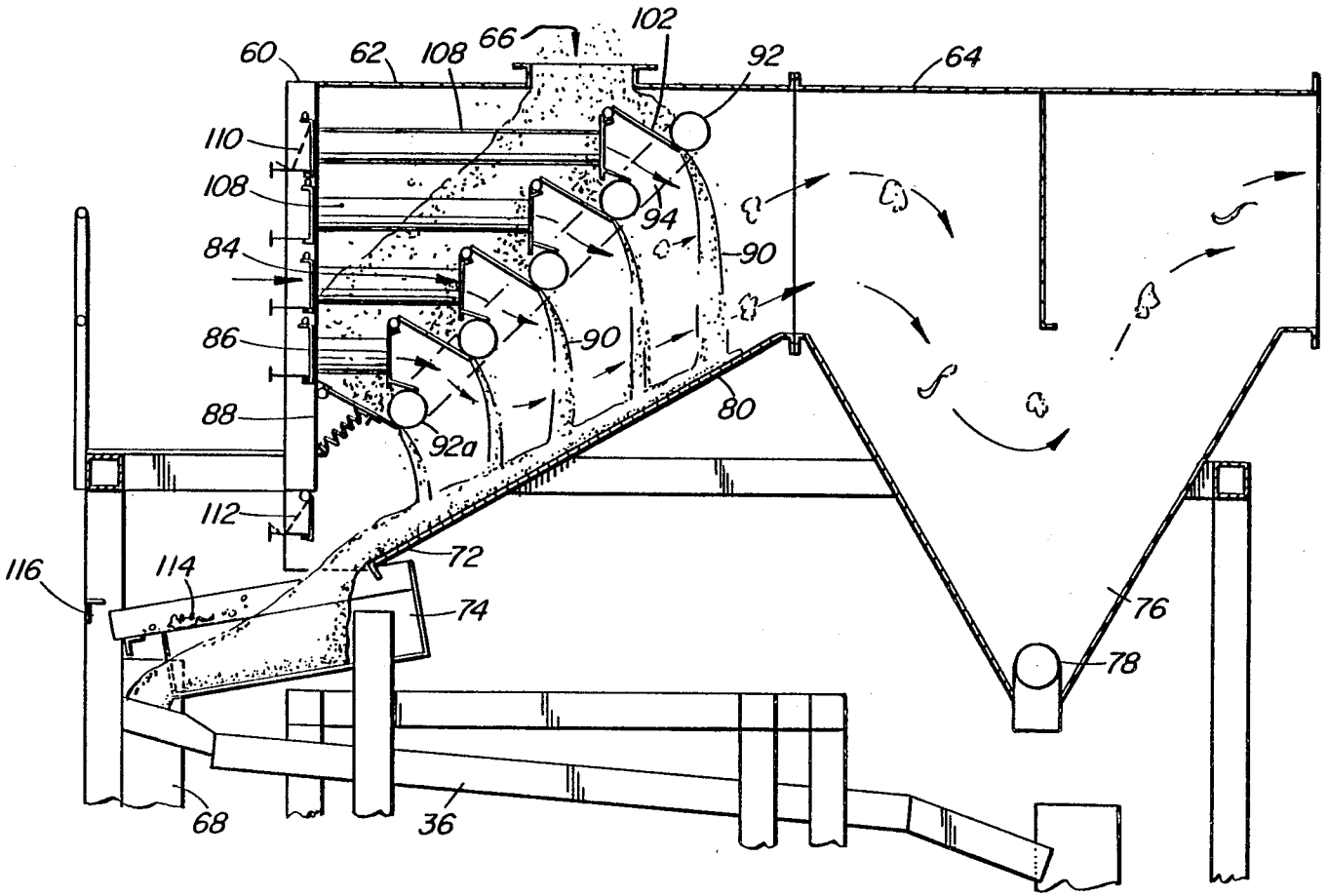
FIG. 5 is a side elevation, partly in section, of the aspirator.
Figure 7:
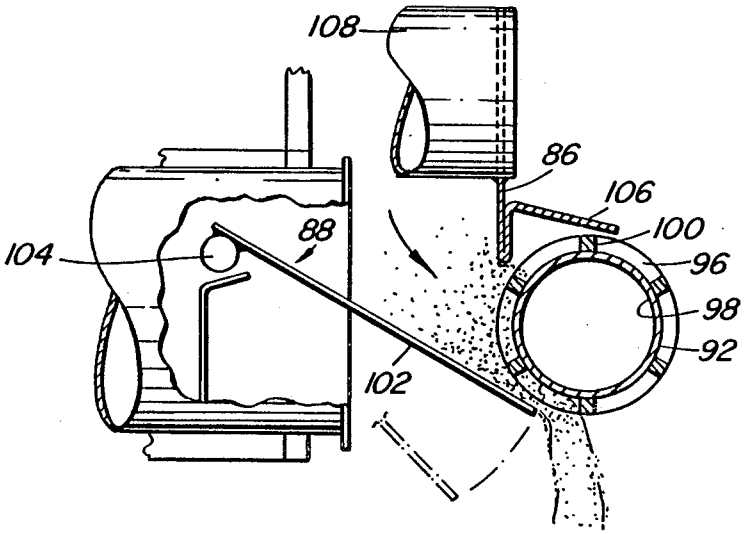
FIG. 7 is a detail of the feed rolls of the aspirator shown in FIG. 5.
Figure 6:
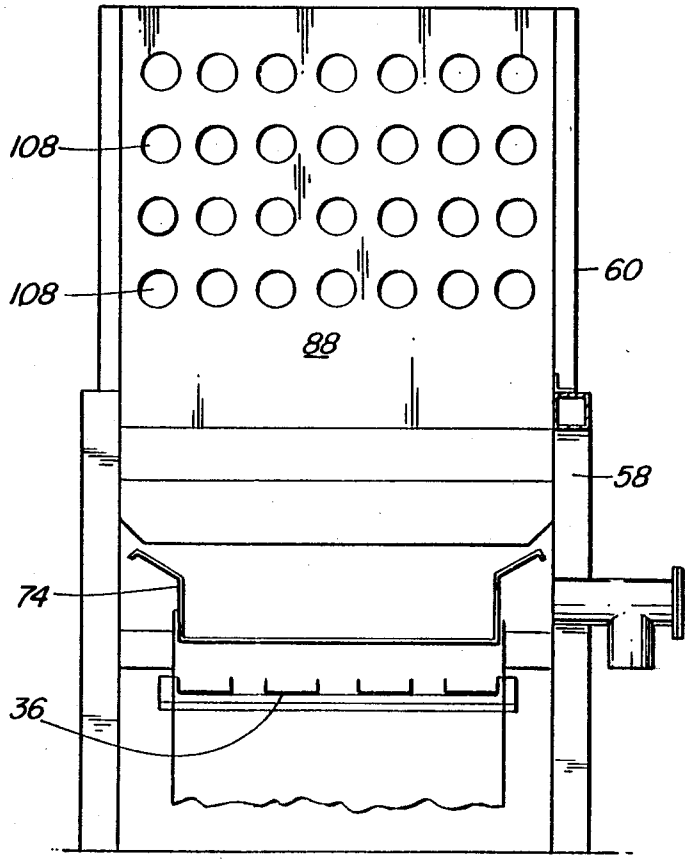
FIG. 6 is a end elevation of the aspirator shown in FIG. 5.
Figure 8:
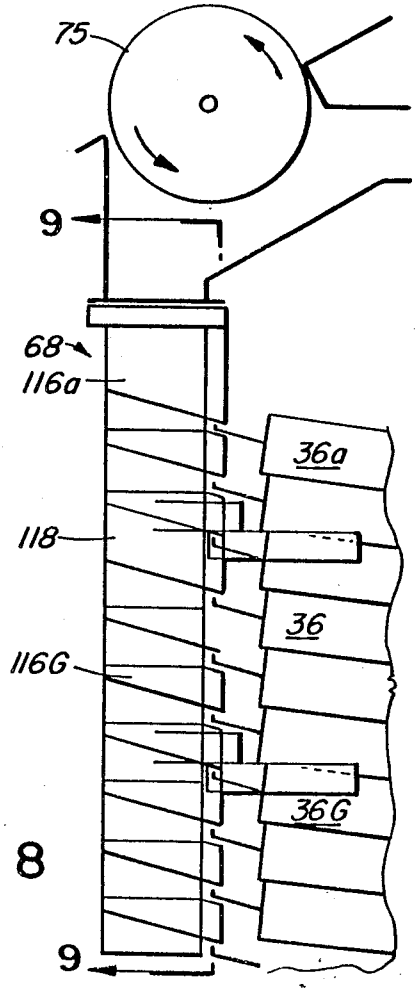
FIG. 8 is a fragmentary side view of the multi-split feed chute.

Turning to FIGS. 3 and 4, the double bank grain cleaner 10 is provided with an aspirator 56 mounted above the cleaner 10 on a suitable frame or stand 58. Briefly, the aspirator precleans the granular material by air currents before that material is fed into the decks 36 of the rotary cleaner. The aspirator comprises a housing 60 having an intake section 62 and an exhaust section 64. Grain is fed downwardly through an inlet 66 in the intake section 62 and, as explained further on, carries on downwardly into a split feed assembly 68. Cleaning air is passed in a generally horizontal path in the direction of arrows 70 through the intake section 62 and out through the exhaust section 64 of the housing, generally at right angles to the downwardly falling grain. Referring to FIGS. 5 through 7 inclusive it will be seen that the intake section 62 has, in addition to the grain inlet 66, an outlet 72 in its lower end where the granular material is fed into a shaker box or scalping deck 74 before proceeding to the split feed apparatus 68 and thereafter to the decks 36. In place of the scalping deck 74 an alternate circular drum screen 75 can be used as shown in FIG. 8. Referring to FIG. 5, the exhaust section 64 of the housing has a large V-shaped trough 76 with a suitable conveyor 78 in the lower end thereof. The air currents passing through the inlet and outlet sections of the housing carry dust and other material lighter than grain into the exhaust section 64, and dust being carried through the exhaust outlet and the heavier material dropping down into the trough 76 where it is subsequently carried away by the conveyor 78. The air flow through the aspirator housing can be created by pressure fans from the inlet side or by suction fans from the exhaust side to pull air through from the inlet to exhaust sections, the speed of the air flow through the downwardly falling grain is kept at a constant speed and is assisted by the tapering shape from the bottom surface 80 of the inlet section 62 which extends to the point of connection between the inlet and the outlet sections 62, 64. The air speed can of course be controlled by either venting the air to the suction fan or by adjusting the amount of air entering the inlet section. The air speed is adjusted so that it will not pull the grain or other granular material into the dropout but will only take the lighter weight pieces such as stocks, empty wheat heads, chaff or dust.

The inlet section 62 is sub-divided in a generally diagonal direction by a baffle shown generally at 82 separating the intake section between its granular inlet and outlet areas. The baffle consists of a stepped panel 84 that extends from one end wall 88 of the housing 60 to the top wall thereof, the panel 84 having a series of vertical sections 86 separated by horizontal sections 88. Means are provided in the baffle for metering a granular material therethrough in a plurality of downwardly flowing curtains of grain 90, the curtains extending substantially across the complete intake section 62. The metering means may take any suitable form but in the embodiment illustrated, the means comprises a plurality of feed rolls 92 interconnected by any suitable means such as a drive chain 94 for operating in unison in response to suitable drive means, not shown. Each of the feed rolls 92 has, as shown in FIG. 7, end walls 96 and a main drum surface 98 with a series of spaced, longitudinally extending bars or paddles 100 secured to the surface thereof. The granular material in the intake section 62 falls by gravity onto the surfaces of the baffle and specifically onto gate members 102 which are spring loaded to a point where a desired amount of nip exists between the surface of the gate and the bars of the feed rolls. The spring loading of the gate 102 allows it to pass any oversized material such as stones, mice, etc. through to the outlet 72. As seen in FIG. 7, the gates 102 are pivoted at 104 to the baffle 88, the vertical plates 86 of the baffle having an eyebrow section 106 to prevent grain from spilling out the top of the rolls.

Means for directing air through the housing 60 consists of a plurality of ducts 108 which extend from the end wall 88 of the housing through to the vertical walls 86 of the baffle 84. It will be evident from FIGS. 5 and 7 that the uppermost banks of conduits 108 directs air underneath the uppermost gate 102 to impinge upon the uppermost grain curtain 90 falling downwardly from the feed roll 92. In similar fashion, each of the succeeding lower banks of conduits direct their air against their respective associated gates and grain curtains so as to lift the lighter weight pieces and dust from the grain curtains and pull them into the exhaust section 64 where they will drop down into the trough 76.

It will also be noted that the end wall 88 has a plurality of adjustable air gates 110 over the end of the conduits as well as a lowermost gate 112 which allows inlet air to contact the lowermost grain curtain 92*a*.

The shaker box 74 separates the granular material from larger objects such as stones or small animals 114 and passes them on the outside to a dropout pipe 116.

The aspirator of the present invention has the capacity to handle the granular flow of high capacity, double bank grain cleaners. In numerous types of conventional grain cleaning devices, large capacity machines cannot be used because there is insufficient vertical space above them to accommodate a number of standard forms of aspirators which would be required. With the present invention, the use of a plurality of feeders to create a number of grain curtains through which air is passed overcomes many of the disadvantages of known devices. It will also be appreciated that the grain inlet gate 102 and air gate 110 are adjustable to suit the form and type of granular material being cleaned.

Figure 10:
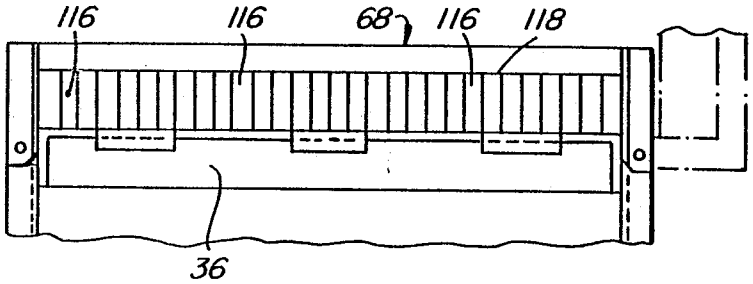
FIG. 10 is a plan view of the chute.
Figure 9:
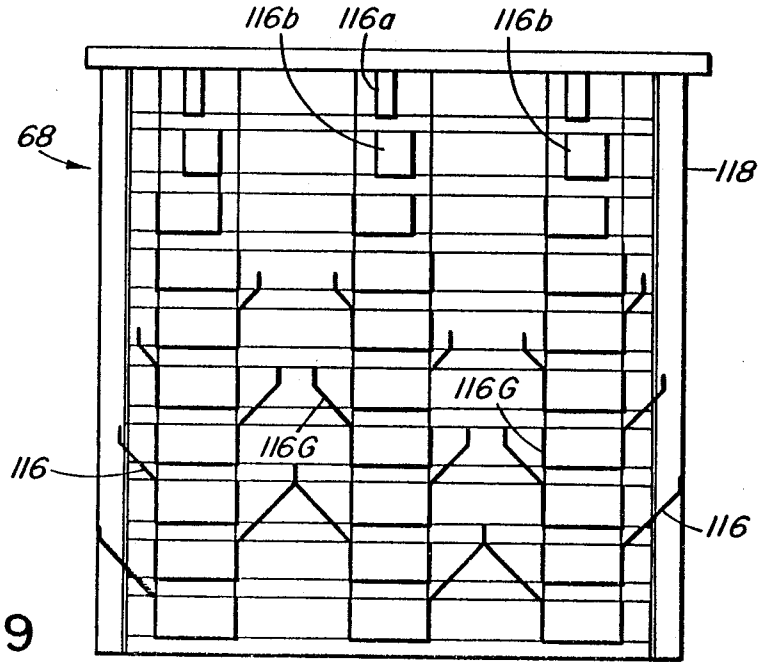
FIG. 9 is a sectional view of the chute taken along line 9—9 of FIG. 8.

FIGS. 8, 9 and 10 illustrate the split infeed assembly 68 in greater detail. On a ten deck machine of the type shown in the drawings the chute 68 splits the flow equally to all ten decks. One advantage of the chute arrangement of this invention is that the flow of granular material enters the decks with the discharge chutes all in line vertically, three vertical lines of chutes 116 being shown in FIG. 9. Conventionally, chutes are staggered and feed to their associated decks in different positions across the width thereof.

The infeed assembly 68 comprises a manifold housing 118 which includes, in the example shown, thirty divisions 120, FIG. 10, providing three equally spaced chutes 116 for each deck 36. As shown in FIG. 9, chutes 116*a* for the uppermost or first deck 36*a* are the narrowest in width in the manifold 68, each set of chutes becoming wider with respect to lower decks but each set of chutes claiming an equal amount of the downwardly falling granular material. Thus, chutes $\mathbf{116}^{G}$ feeding the seventh deck $\mathbf{36}^{G}$ are wide to claim the same portion of the grain curtain as the uppermost chutes 116*a*.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitation and there is no intention in the use of such terms and expressions to exclude any equivalents of the features shown and described or portions thereof but it is recognized that various modifications are possible within the scope of the invention claimed.

The embodiments of the invention in which an exclusive property or privilege is claimed are defined as follows:

1. A double bank cleaning device for granular and like material comprising:

an outer, open frame of rectangular configuration having spaced end frames interconnected by upper and lower cross beams;

an inner frame suspended from said outer frame by universal joints thereby to allow said inner frame to move in a horizontal plane relative to said outer frame;

two spaced banks of cleaning decks mounted in and secured to said inner frame, said decks having infeed ends and outlet ends extending beyond the confines of the outer frame and adapted to convey granular material throughout their length; and drive means mounted on said inner frame between said spaced banks of cleaning decks, said drive means comprising a box enclosure secured to the inner frame, a dead shaft vertically mounted in said box enclosure, an eccentric weight mounted for rotation in a horizontal plane on said dead shaft and motor means for rotating said weight thereby to impart a flat, rotary motion to said suspended inner frame and the double bank of cleaning decks secured therein; and including a multi-feed aspirator for feeding granular material into said cleaning device, said aspirator comprising a housing mounted above said outer frame;

a plurality of horizontally disposed feed rolls mounted in said housing, one above and forward of the other, each roll feeding a curtain of granular material, by gravity, down through the housing and into said infeed ends of said decks, and a plurality of ducts directing air generally horizontally against said curtains of granular material to carry lighter-than-grain pieces into a drop out section.

2. An aspirator for mounting on top of a grain cleaning machine comprising:

a housing having an intake section and an exhaust section, said housing being adapted for connection to fan means for passing air through said housing from the intake to the exhaust sections;

said intake section having an inlet in its upper end for receiving granular material therein, and an outlet in its lower end for dropping granular material into cleaning decks of said cleaning machine;

baffle means dividing said intake section between its granular inlet and outlet and extending generally diagonally across said intake section;

means in said baffle means for metering granular material therethrough in a plurality of downwardly flowing curtains extending across said intake section; and means for directing the air passing through the housing to impinge upon said downwardly flowing curtains thereby to carry material lighter than said granular material out of said intake section and into said exhaust section;

said baffle means comprising a stepped panel extending generally diagonally from one end wall of the intake section to the top wall thereof, said stepped panel having a series of vertical sections separated by horizontal sections, said metering means being located in the horizontal sections and the air directing means being located in the vertical sections;

said metering means comprises a plurality of feed rolls extending across said baffle means, each feed roll being located adjacent to and below said vertical and horizontal sections, and gate members in the horizontal sections in contact with the feed rolls for passing granular material through the baffle means, and drive means for rotating said feed rolls.

3. An aspirator according to claim 2, wherein the air directing means comprises a plurality of ducts extending between an outer wall of said housing and the baffle means and being directed towards the curtains of downwardly falling granular material.

* * * * *